US005102497A

United States Patent [19]

Hamaguchi et al.

[11] Patent Number: 5,102,497

[45] Date of Patent: Apr. 7, 1992

[54] TRANSFER MEMBER WITH A METALLIC LUSTER PATTERN AND METHOD FOR MANUFACTURING THE SAME

[75] Inventors: Masami Hamaguchi; Yoshisuke Komoda, both of Tokyo; Osamu Hiraoka, Osaka; Hajime Takemura; Yoshiharu Tsuji, both of Kyoto; Shigekazu Namura; Hiromoto Ogawa, both of Kyoto, all of Japan

[73] Assignees: Nissha Printing Co., Ltd., Kyoto; Shiseido Co., Ltd., Tokyo, both of Japan

[21] Appl. No.: 476,482

[22] PCT Filed: May 19, 1989

[86] PCT No.: PCT/JP89/00503

§ 371 Date: Jun. 19, 1990

§ 102(e) Date: Jun. 19, 1990

[87] PCT Pub. No.: WO90/03279

PCT Pub. Date: Apr. 5, 1990

[30] Foreign Application Priority Data

Sep. 30, 1988 [JP] Japan ..... 63-248857

[51] Int. Cl.[5] ..... C23F 1/00

[52] U.S. Cl. ..... 156/656; 156/659.1

[58] Field of Search ..... 156/656; 427/146, 208.8; 428/204, 200

[56] References Cited

U.S. PATENT DOCUMENTS 4,515,849 5/1985 Keino et al. ..... 428/204
4,687,680 8/1987 Narui et al. ..... 427/208.8
4,902,364 2/1990 Parker et al. ..... 156/233

FOREIGN PATENT DOCUMENTS 38-18316 9/1963 Japan .
49-101803 9/1974 Japan .
53-21124 6/1978 Japan .
53-127018 11/1978 Japan .
60-104388 6/1985 Japan .
62-199398 12/1987 Japan .
63-58102 11/1988 Japan .
1-45698 2/1989 Japan .

*Primary Examiner*—Patrick J. Ryan
*Assistant Examiner*—Kam F. Lee
*Attorney, Agent, or Firm*—Wenderoth, Lind & Ponack

[57] ABSTRACT

A transfer member with a pattern of metallic luster is so constructed that a release layer is formed on the whole surface of a release sheet, a metal thin film layer is formed on the release layer, and a pattern-like adhesive layer including thermosetting resin and 5–70 parts by weight of loading pigment is formed thereon. As required, the metal thin film layer is partially formed to partially form a color adhesive layer on the release layer. The metal thin film layer is formed on the whole surface of the release layer formed on the whole surface of the release sheet, then, the pattern-like adhesive layer is formed on the metal thin film layer, thereafter a part of the metal thin film layer which is not covered with the adhesive layer is dissolved and removed therefrom by alkaline or acidic aqueous solution, and then the pattern-like color adhesive layer is formed thereon to manufacture a transfer member. In another method, a pattern-like water-soluble resin layer is formed on the release layer formed on the whole surface of the release sheet, then, the metal thin film layer is formed on the whole surface thereof, and thereafter it is washed by water to dissolve and remove the metal thin film layer therefrom. Then, the adhesive layer is formed on a part overlapped with the metal thin film layer, and then the pattern-like color adhesive layer is formed thereon to manufacture a transfer member. Another transfer member is so constructed that the metal thin film layer is formed on the whole surface of the release sheet through a first release layer, the pattern-like adhesive layer is formed thereon, a second release layer is formed on a part not to overlap with the adhesive layer, and then the pattern-like color adhesive layer is formed thereon.

1 Claim, 4 Drawing Sheets

TRANSFER MEMBER WITH A METALLIC LUSTER PATTERN AND METHOD FOR MANUFACTURING THE SAME

TECHNICAL FIELD

The invention relates to a transfer member with a metallic luster pattern which is capable of forming a beautiful metallic luster pattern on the surface of a substrate made of glass or the like.

BACKGROUND ART

Conventionally, there has been a kind of transfer member capable of forming a metallic luster pattern on the surface of a heat-resistant substrate such as a glass container which is disclosed in, for example, Japanese Patent Publication No. 38-18316 and Japanese Laid-open Utility Model Publication No. 49-101803, in which a release layer and a metal thin film layer are laminated in order on a substrate sheet having release characteristics and then a pattern-like adhesive layer is laminated thereon.

The transfer member having such a construction is overlapped on the surface of a substrate to be transferred such as a glass container, heated and pressed, with the result that the adhesive layer is fused to be closely attached to the substrate to be transferred. Sequentially, the substrate sheet is released from the member to remove from the member parts of the metal thin film layer and the release layer on which the adhesive layer is not formed, and thus to form a metallic luster pattern on the substrate to be transferred.

In this case, when the adhesive layer has small adhesiveness, the metallic luster easily comes away from the substrate to be transferred by contacting or scratching. Then, there has been proposed that thermosetting resin is employed for the adhesive layer, and heated to cure the adhesive layer after the transfer process, resulting in improvement of the adhesiveness thereof.

However, the heat process for curing causes the thermosetting resin to shrink, and thus, the problem occurs that when the adhesive layer made of the thermosetting resin is heated, small buckling appears on the surface of the adhesive layer by the shrinkage, and the buckling influences the metal thin film layer to tarnish the metallic luster thereof.

Additionally, there has been a transfer member with a metallic luster pattern for simultaneously forming a metallic luster pattern and a printed pattern having no metallic luster, which is disclosed in, for example, Japanese Utility Model Publication No. 53-21124 and Japanese Patent Publication No. 63-58102. The member is so constructed that a transparent release layer capable of easily being removed from a substrate sheet is formed on one surface of the substrate sheet, a coloring layer with any pattern and a water-soluble resin layer are partially formed on the release layer, a metal thin film layer is formed on the whole surface thereof, thereafter the water-soluble resin layer is dissolved and removed therefrom with the metal thin film layer on the water-soluble resin layer by water washing, and then a heat-sensitive adhesive layer is formed on the whole or partial surface of the member to form the member.

When the transfer member having such a construction is transferred on the substrate to be transferred, a metallic luster pattern and a printed pattern can be simultaneously formed on the substrate to be transferred. When the adhesive layer is partially formed thereon, the part of the metal thin film layer, the coloring layer, and the release layer on which the adhesive layer is not formed is removed therefrom with the substrate sheet, and a transparent layer consisting of the adhesive layer and the release layer is transferred only on the metal thin film layer and the coloring layer, resulting in preferable design.

In this case, however, when the adhesive layer has small adhesiveness, the metallic luster pattern layer easily comes away from the substrate by contacting or scratching. Therefore, there has been proposed that thermosetting resin is employed for the adhesive layer, and after the transfer process, the adhesive layer is heated to cure, resulting in improvement of the adhesiveness thereof.

However, when the adhesive layer made of thermosetting resin is heated as described above, a problem of small buckling occurs on the surface of the adhesive layer by shrinkage of the resin, and the buckling influences the metal thin film layer to tarnish the metallic luster thereof.

The object of the invention is to remedy the above-described problems and to provide a metallic luster pattern transfer member capable of forming a beautiful metallic luster pattern.

The other object of the invention is to remedy the above-described problems and to provide a metallic luster pattern transfer member capable of simultaneously forming a beautiful metallic luster pattern and a printed pattern having no metallic luster, and a method for manufacturing the same.

DISCLOSURE OF INVENTION

In order to achieve the objects, the invention is constructed as follows. That is, a transfer member with a metallic luster pattern according to the present invention is so constructed that a release layer is formed on the whole surface of a release sheet, a metal thin film layer is formed at a specific portion of the release layer thereon, and an adhesive layer comprised of thermosetting resin and 5–70 parts by weight of pigment (color) is formed in a pattern as the upper-most layer of the release sheet on which the release layer and the metal thin film layer are formed. Therefore, any influence of shrinkage of the resin in the heating process after the transfer process is not given to a metallic luster pattern formed by the transfer member of the present invention, and thus a beautiful metallic luster pattern can be obtained.

A transfer member of, a metallic luster pattern according to a second embodiment of the present invention is so constructed that a metal thin film layer is formed on the whole surface of a release sheet through a first release layer, a pattern-like adhesive layer comprised of thermosetting resin and 5–70 parts by weight of pigment is formed thereon, a second release layer is formed on a part thereof which is not overlapped with the adhesive layer, and then a pattern-like color adhesive layer is formed thereon. Therefore, any influence of shrinkage of the resin in the heating process after the transfer process is not given to a metallic luster pattern formed by the transfer member of the present invention, and thus a beautiful metallic luster pattern and the printed pattern can be formed by one transfer process.

A transfer member with a metallic luster pattern according to a third embodiment of the present invention is so constructed that a release layer is formed on the whole surface of a release sheet, a metal thin film layer is partially formed on the release layer, a pattern-like adhesive layer comprised of thermosetting resin and 5-70 parts by weight of pigment is formed on the metal thin film layer, and a pattern-like color adhesive layer is partially formed on the release layer. Therefore, any influence of shrinkage of the resin in the heating process after the transfer process is not given to a metallic luster pattern formed by the transfer member of the present invention in one transfer process, and thus a beautiful metallic luster pattern and the printed pattern can be formed by one transfer process.

A method for manufacturing a transfer member with a metallic luster pattern according to the present invention is so constructed that a release layer is formed on the whole surface of a release sheet, a metal thin film layer is formed on the whole surface thereof, then a pattern-like adhesive layer comprised of thermosetting resin and 5-70 parts by weight of pigment is formed on the metal thin film layer, thereafter a part of the metal thin film layer on which the adhesive layer is not formed is dissolved and removed therefrom by alkaline or acidic aqueous solution, and then a pattern-like color adhesive layer is formed on the release layer. Therefore, a transfer member can be easily manufactured which is capable of simultaneously forming a beautiful metallic luster pattern and a printed patter having no metallic luster.

Another method for manufacturing a transfer member with a metallic luster pattern of the present invention is so constructed that a release layer is formed on the whole surface of a release sheet, a pattern-like water-soluble resin layer is formed thereon, then a metal thin film layer is formed on the whole surface of the upper-most layer of the release sheet on which the release layer and the water-soluble resin layer are formed, thereafter the water-soluble resin layer is dissolved and removed therefrom with the metal thin film layer formed on the water-soluble resin layer by water washing, then a pattern-like adhesive layer comprised of thermosetting resin and 5-70 parts by weight of pigment is formed on a part thereof which is over-lapped with the metal thin film layer, and then a pattern-like color adhesive layer is formed on the release layer. Therefore, a transfer member can be easily manufactured which is capable of simultaneously forming a beautiful metallic luster pattern and a printed pattern having no metallic luster.

BEST MODE FOR CARRYING OUT THE INVENTION

Figure 1:
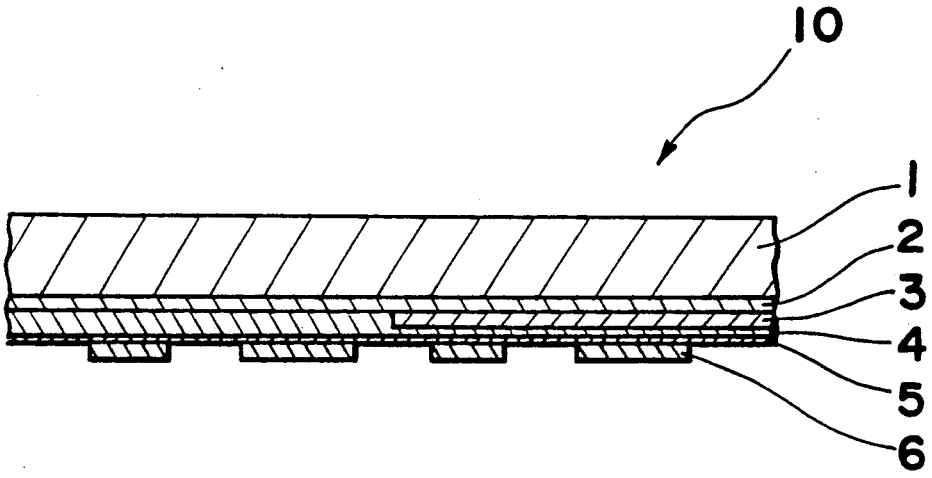
FIG. 1 is a cross-sectional view showing one embodiment of a transfer member with a metallic luster pattern according to a first embodiment of the present invention.

The embodiments of the present invention will be described in detail referring to the drawings.

Figure 2:
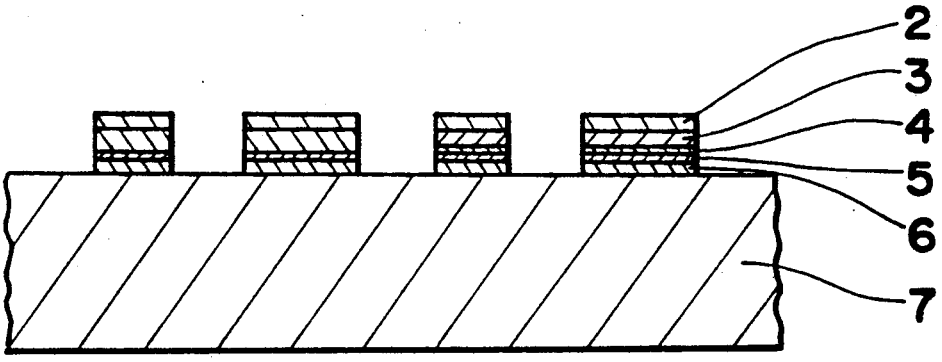
FIG. 2 is a cross-sectional view showing a state where the transfer member in FIG. 1 has been transferred to a substrate to be transferred.

FIG. 1 is a cross-sectional view showing a transfer member 10 with a metallic luster pattern according to the first embodiment of the present invention. FIG. 2 is a cross-sectional view showing a state where the transfer member 10 of the first embodiment has been transferred to a substrate 7 to be transferred. Reference number 1 denotes a release sheet, that is, a substrate sheet having release characteristics, 2 denotes a release layer, 3 denotes a coloring layer, 4 denotes an anchor layer, 5 denotes a metal thin film layer, 6 denotes an adhesive layer, and 7 denotes a substrate to be transferred.

A known substrate sheet for a transfer member, for example, a plastic film such as polyethylene terephthalate, polypropylene, polyethylene, cellulose derivative, nylon, or cellophane, or a composite film composed of the plastic film and another film-like member such as a paper or a bonded fabric, is employed for the substrate sheet 1. In order to improve the release characteristic of the substrate sheet 1, a known release process can be performed on the surface of the sheet 1.

The release layer 2 is formed on the whole surface of the sheet 1 and is a layer to be the surface of the metal thin film layer 5 after being released from the sheet 1 in a transfer process. The material of the release layer 2 is suitably selected from thermoplastic resin.

In a case where it is required for the surface of the release layer to be physically and chemically hard, ultraviolet curing resin, electron radiation curing resin, or curable resin of two-part liquid system can be employed. Considering the ease of coating and the cost thereof, any thermosetting resin such as acrylic resins or gum derivative polymer (gum derivative resin or polymer containing gum derivatives) can be used. The release layer 2 made of such material is formed on the sheet 1 by a known printing method such as a roller coating method, a gravure printing method, or a screen printing method. The thickness of the release layer 2 is 0.2-5.0 μm, and more preferably, 0.5-1.5 μm is suitable. The thickness thereof less than 0.2 μm lacks the surface strength thereof after the transfer process. The thickness thereof more than 5.0 μm causes the edge portions of the transferred pattern to easily be unclear and the transfer pattern to easily be removed therefrom.

The coloring layer 3 is comprised of solvent with a mixture of dye or pigment with synthetic resin and is formed on the partial or whole surface of the release layer 2 as required. For example, when gold color development is required on the whole surface of the release layer 2, the coloring layer 3 with yellow is formed on the whole surface of the release layer 2 and then a metal thin film layer made of metal such as aluminum is formed thereon. When gold and silver color development is required on the release layer 2, the coloring layer 3 with yellow is formed on only a part at which gold color development is required and then a metal thin film layer made of metal such as aluminum is formed thereon, resulting in obtaining a transfer member capable of transferring gold and silver colors simultaneously. The method for forming the coloring layer 3 is not specially limited. For example, it can be formed by a gravure printing method, a screen printing method, or the like.

The anchor layer 4 is a layer to improve the adhesion properties between the release layer 2 or the coloring layer 3 and the metal thin film layer 5 and formed as required. The anchor layer 4 is adhered to the metal thin film layer 5, and either the release layer 2 or the coloring layer 3. The material of the anchor layer 4 to which the metal thin film layer 5 can be fixed is not specially limited. For example, curable urethane resin of two-part liquid system, a mixture of melamine thermosetting resins and epoxy thermosetting resins, or thermoplastic resins such as polyvinyl chloride-acetate resin can be used for the material therefor. The thickness of the anchor layer 4 is 0.2–5.0 μm, preferably 0.2–1.0 μm. The thickness more than 5.0 μm causes a virgin adhesive section thereof not to be removed therefrom with the substrate sheet in releasing the substrate sheet and to leave at the peripheral portion of the pattern thereof, resulting in obtaining an unclear transfer pattern. The thickness less than 0.2 μm does not perform the object of the anchor layer.

The metal thin film layer 5 is formed on the release layer 2 or the whole surface of the coloring layer 3 formed as required, or formed on either of them, or partially formed on both of them. The layer 5 is a layer to appear as a metallic luster pattern. In FIG. 1, the layer 5 is formed on the whole upper surface of the anchor layer 4. The layer 5 is formed by a method such as a vacuum metallizing method, a sputtering method, or an ion plating deposition method. The kind of the metal can be aluminum, nickel, chrome, gold, silver, copper, or brass. The thickness of the layer 5 is 30–100 nm, and specially, 35–60 nm is preferable.

The adhesive layer 6 is a layer to form a metallic luster pattern after the layer 6 causes the layers such as the metal thin film layer 5 to form in a pattern and the layers are transferred on the substrate 7 to be transferred. The adhesive layer 6 is formed by a method such as a screen printing method. The adhesive layer 6 is composed of loading pigment and thermosetting resin such as a mixture of acrylic thermosetting resins and melamine thermosetting resins, a mixture of acrylic thermosetting resins and melamine thermosetting resins and epoxy thermosetting resins. The use of the thermosetting resin causes a heating process to be performed after the transfer process, resulting in necessary hardness. The use of the pigment prevents volume shrinking of the adhesive layer 6 in the heating process and prevents the metallic luster thereof from being tarnished. Silica, precipitated barium sulfate, magnesium carbonate, or the like can be suitable for such pigment. The compounding ratio of the thermosetting resin and the pigment is 5–70 parts by weight of the pigment with respect to the thermosetting resin. Specially, it is preferably 20–60 parts by weight thereof. Less than 5 parts of the body pigment can not prevent the volume shrinking of the adhesive layer 6. Excessive loadings of the body pigment causes bad influence such as poor adhesion properties. One example of the relation between the loadings of the body pigment and the characteristic of the transfer member is shown in Table 1. The thickness of the adhesive layer 6 is 0.3–20 μm. The thickness thereof less than 0.3 μm causes poor transfer characteristics and poor sensation of three dimensional reality. The thickness thereof more than 20 μm causes the metal pattern to be crushed by heat and pressure in transferring, resulting in obtaining unclear appearance.

In Table 1 shown below, glossiness is judged by eye. That is, ◎ shows very good, O shows good, Δ shows acceptable, and X shows not acceptable. The transfer adhesion properties are judged by a crosscut adhesive test described below. That is, the cutting edge of a single-edge blade put on the vertical surface of a metallic luster pattern transferred onto a substrate to be transferred is held at approximately 30 degrees with respect to the effective surface of the pattern, and a hundred squares (10×10) are formed by the cutting edge, a cutting groove between the squares reaching the substrate, which length is 1 mm. Then, on the basis of Japanese Industrial Standard (JIS) Z 1522, an adhesive cellophane tape, having a width of 12 mm, is completely and closely adhered onto the squares. Immediately, one end of the tape makes a right angle with the surface of the metallic luster pattern, and momentarily, is pulled from the surface. Thereafter, the number of the squares left on the surface, which are not completely pulled away therefrom, is counted. ◎ shows that the number of the squares left without pulling away is 100, Δ shows that the number is more than 90, Δ shows that the number is not less than 60, and X shows that the number is less than 60.

TABLE 1

| | | | | | | | | | |
|---|---|---|---|---|---|---|---|---|---|
| content of loading pigment (%) | 0 | 5 | 10 | 20 | 40 | 60 | 70 | 80 | 90 |
| volume shrinkage factor of resin (%) | 10 | 9.5 | 9 | 8 | 6 | 4 | 3 | 2 | 1 |
| glossiness | X | Δ | O | ◎ | ◎ | ◎ | O | X | X |
| transfer adhesion properties | ◎ | ◎ | ◎ | ◎ | ◎ | ◎ | O | Δ | X |

The transfer member 10 with the metallic luster pattern according to the first embodiment, as shown in FIG. 1, is constructed as follows. The adhesive layer 6 is composed of thermosetting resin and 5–70 parts by weight of pigment. On the substrate sheet 1 with the release characteristic, the release layer 2 and the metal thin film layer 5 are formed in order and then the pattern-like adhesive layer 6 is laminated thereon.

The transfer member 10 is overlapped with the substrate 7 to be transferred, of which the metallic luster pattern tends to be transferred on the substrate 7, so as to contact the adhesive layer 6 with the substrate 7, and then heat and pressure is applied to the substrate sheet 1 to be closely adhered with each other. Thereafter, the sheet 1 is released therefrom. As a result, as shown in FIG. 2, the release layer 2 and the metal thin film layer 5 are released with the sheet 1 from the substrate 7 in a section having no adhesive layer 6, while in the section having the adhesive layer 6, releasing is performed at the interface between the sheet 1 and the release layer 2 in correspondence with the pattern of the adhesive layer 6, so that the release layer 2 and the metal thin film layer 5 are left on the substrate 7, resulting in forming a metallic luster pattern on the substrate 7.

In a case where the substrate 7 is made of glass, in order to obtain stronger physical and chemical strength, a silane-coupling agent process may be previously performed on the glass.

The adhesive layer 6 of the transfer member 10 with a metallic luster pattern according to the first embodiment is comprised of thermosetting resin and 5–70 parts by weight of pigment. Therefore, the metallic luster pattern formed by the transfer member 10 is not influenced by the shrinking of thermosetting resin in the heating process after the transfer process, resulting in obtaining a beautiful metallic luster pattern.

Material for use in a known transfer process such as glass or plastic can be used for the substrate 7 onto which the transfer member 10 of the first embodiment is transferred and the material of the substrate 7 is not especially limited. As long as the transfer method is a known method such as a roller transfer method using a roll type-heating transfer apparatus, an up-down heat transfer method in which a press member, such as silicon rubber, for pressing a transfer member to a substrate to be transferred is moved upward and downward to transfer, or an in-mold transfer method, the method is not especially limited. This point is similarly applied to other embodiments of the present invention.

Hereinbelow, one concrete example of the first embodiment is shown.

(EXAMPLE 1)

On a 25-μm thick polyethylene terephthalate film as a substrate sheet, a 2-μm thick release layer was formed with ink composed of acrylic resins (BR-80 made by Mitsubishi Rayon Co., Ltd.) by a gravure printing method. Furthermore, a 0.8-μm thick anchor layer was formed with curable polyurethane resin of two-part liquid system (weight ratio; Takelac A-2070 made by Takeda Chemical Industries: Takenate A-3=15:1) by a gravure printing method. Then, it was heated for 30 seconds at 160° C.

Moreover, aluminum was evaporated thereon by a metallizing method based on a known electronic heating method to form a 50-nm thick metal thin film layer.

Finally, a 4-μm thick, pattern-like adhesive layer was formed by a screen printing method with ink composed of the composition 1 described below, and thus a transfer member with a metallic luster pattern was obtained.

| Composition 1 | (parts by weight) |
|---|---|
| Thermosetting acrylic resin (HR-116 made by Mitsubishi Rayon Co. Ltd.) | 80 |
| Melamine resin (20SE-60 made by Mitsui Toatsu Chemicals, Inc.) | 20 |
| Precipitated barium sulfate | 40 |
| Isophorone | 20 |

The transfer member was transferred to a glass bottle processed by silane-coupling agent (A-1160 made by Nippon Unicar Co., Ltd.). Then, by heating for 30 minutes at 180° C., the adhesive layer thereof was cured, and simultaneously, the fixing strength of the adhesive layer with respect to the glass bottle was improved. The surface strength of the metallic luster pattern of the obtained product was very excellent and the pattern gave a sensation of a very high three dimensional reality.

Figure 3:
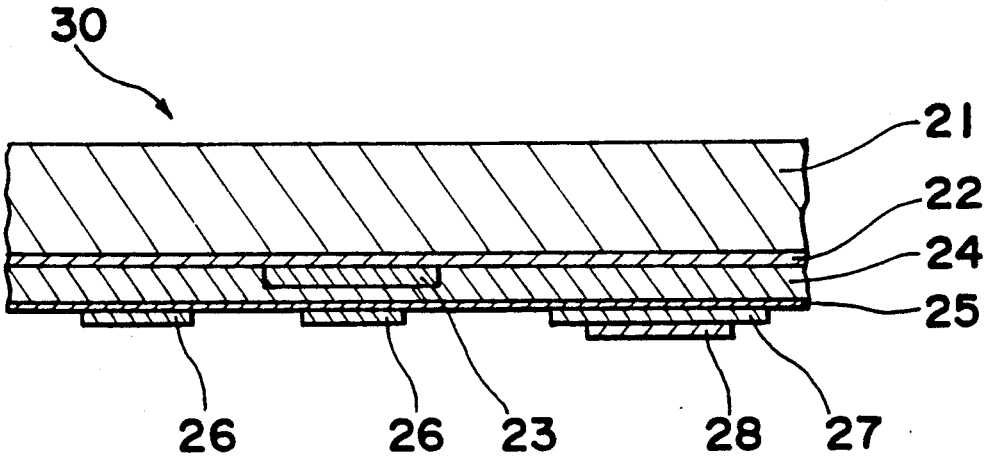
FIG. 3 is a cross-sectional view showing a transfer member according to a second embodiment of the present invention.
Figure 4:
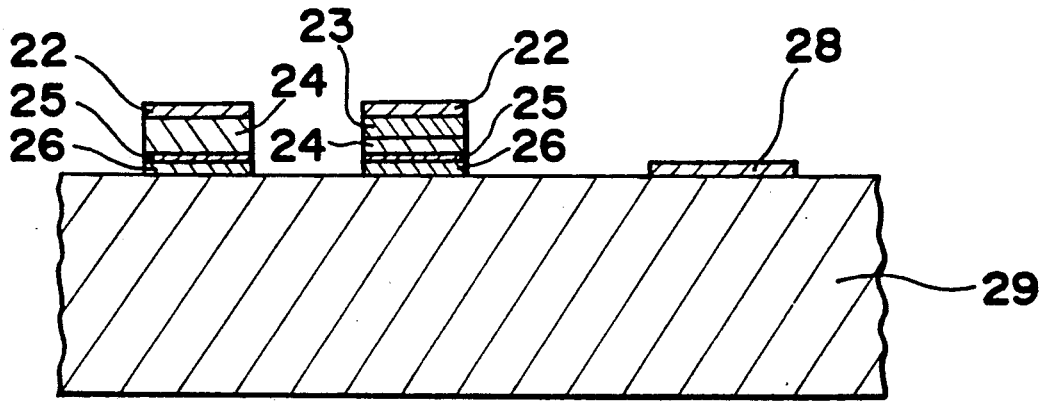
FIG. 4 is a cross-sectional view showing a state where the transfer member in FIG. 3 has been transferred to a substrate to be transferred.

Next, FIG. 3 is a cross-sectional view showing a transfer member 30 with a metallic luster pattern according to a second embodiment of the present invention. FIG. 4 is a cross-sectional view showing a state where the transfer member 30 of the second embodiment has been transferred to a substrate 29 to be transferred. Reference number 21 denotes a release sheet, that is, a substrate sheet having release characteristics, 22 denotes a first release layer, 23 denotes a coloring layer, 24 denotes an anchor layer, 25 denotes a metal thin film layer, 26 denotes an adhesive layer, 27 denotes a second release layer, 28 denotes a color adhesive layer, and 29 denotes a substrate to be transferred.

The same sheet as the substrate sheet 1 of the transfer member 10 according to the first embodiment is used for the sheet 21.

The first release layer 22 is formed on the whole surface of the sheet 21 and is released from the sheet 21 after a transfer process to be a layer which is the surface of the metal thin film layer 5. The material of the release layer 22 can be thermoplastic resin, thermosetting resin, or curable resin of two-part liquid system Specially, in a case where it is required for the surface of the release layer to be hard, ultraviolet curing resin or electron radiation curing resin can be employed. The first release layer 22 made of such material is formed on the sheet 21 by a known printing method such as a roller coating method, a gravure printing method, or a screen printing method.

The metal thin film layer 25 is formed on the whole surface of the first release layer 22 to give a metallic luster appearance. In FIG. 3, the layer 25 is formed on the whole upper surface of the anchor layer 24. The layer 25 is a layer to give a metallic luster appearance to the pattern formed by the adhesive layer 26. The method for forming the metal thin film layer 25, and the material and thickness of the layer 25 are the same as those of the metal thin film layer 5 of the transfer member 10 according to the first embodiment.

The pattern-like adhesive layer 26 is formed on the thin film layer 25, and then the pattern-like first release layer 22 and the pattern-like metal thin film layer 25 are formed to give a metallic luster pattern on the substrate 29 to be transferred after the transfer process The method for forming the adhesive layer 26, and the material and the thickness of the adhesive layer 26 are the same as those of the adhesive layer 6 of the transfer member 10 according to the first embodiment.

The second release layer 27 is formed on a part, which is not overlapped with the adhesive 26, of the metal thin film layer 25. After the transfer process, the layer 27 is released from the color adhesive layer 28 at the interface between the layers 27 and 28 and the layer 27 is removed therefrom with the substrate sheet 21. As required, the second release layer 27 can be released from the metal thin film layer 25 at the interface between the second release layer 27 and the metal thin film layer 25 in correspondence with the color adhesive layer 28 so that the second release layer 27 can be adhered to the substrate 29 with the color adhesive layer 28. The kind of resin to use for the second release layer 27 is silicone resins, fluorine plastic resins, cellulose acetate, cellulose acetate butyrate, or cellulose derivative polymer (cellulose derivative resin) such as nitrate. As long as the resin is for releasing at the interface between the second release layer 27 and either the color adhesive layer 28 or the metal thin film layer 25, the resin is not especially limited. The printing method of the second release layer 27 can be a gravure printing method, a screen printing method or the like, and for simplified processes, the screen printing method is preferable because the color adhesive layer 28 sequentially formed after the second release layer 27 is preferably formed by the screen printing method.

The color adhesive layer 28 is formed on the second release layer 27 and forms a printed pattern having no metallic luster on the substrate 29 by being released at the interface between the color adhesive layer 28 and the second release layer 27 after the transfer process. As described above, the color adhesive layer 28 can be released at the interface between the layer 28 and the metal thin film layer 25 in correspondence with the color adhesive layer 28 to form a printed pattern on the substrate 29 as required Thermoplastic resin, thermosetting resin, curable resin of two-part liquid system, ultraviolet curing resin, or electron radiation curing resin can be used for the material of the color adhesive layer 28. In order to obtain a desired color, a resin is used which is so composed that pigment or dye for giving the desired color is mixed into solvent to an ink state, because the printed pattern is formed on the surface of the substrate 29 after the transfer process.

As required, as shown in FIG. 3, the color layer 23 can be formed between the first release layer 22 and the metal thin film layer 25. The color layer 23 is for coloring a metallic luster pattern, and is formed on the partial or whole surface thereof as required, and is the same as the color layer 3 of the first embodiment.

Before the metal thin film layer 25 is formed, the anchor layer 24 is formed as required in order to improve the adhesion properties of the metal thin film layer 25. The anchor layer 24 is a layer to be a support layer of the metal thin film layer 25. The material of the anchor layer 24 to which the metal thin film layer 25 is fixed is not especially limited. The material and thickness of the anchor layer 24 are the same as those of the anchor layer 4 of the transfer member 10 according to the first embodiment.

The transfer member 30 of the second embodiment is used by the following method. For example, after the transfer member 30 is overlapped with the substrate 29, it is heated and pressed or either heated or pressed.

Next, when the substrate sheet 21 is released therefrom as shown in FIG. 4, the release is performed at the interface between the substrate sheet 21 and the first release layer 22 in a part having the adhesive layer 26, and then a part of both of the first release layer 22 and the metal thin film layer 25 in correspondence with the adhesive layer 26 and the adhesive layer 26 are adhered to the surface of the substrate 29 to form a metallic luster pattern. The reason is that the adhesion strength between the substrate sheet 21 and the first release layer 22 is less than that between the other layers.

In a part in which the second release layer 27 is intervened, the release is performed at the interface between the second release layer 27 and the color adhesive layer 28, and the color adhesive layer 28 is adhered to the surface of the substrate 29 to form a printed pattern The reason is that the adhesion strength between the second release layer 27 and the color adhesive layer 28 is less than that between the other layers.

In a part in which the adhesive layer 26 and the color adhesive layer 28 do not exist, the release layers 22 and 27 and the metal thin film layer 25 are not adhered to the substrate 29 and are released therefrom with the substrate sheet 21.

The transfer member 30 of the second embodiment is so constructed that the metal thin film layer 25 is formed on the whole surface of the substrate sheet 21 through the first release layer 22, then, the pattern-like adhesive layer 26 composed of thermosetting resin and 5–70 parts by weight of pigment is formed thereon, the second release layer 27 is formed at a part which is not overlapped with the adhesive layer 26, and then the pattern-like color adhesive layer 28 is formed thereon Therefore, the metallic luster pattern formed by the transfer member 30 is not influenced by the shrinking of thermosetting resin in the heating process after the transfer process, so that a beautiful metallic luster pattern and a printed pattern can be formed by one transfer process.

Hereinbelow, one concrete example of the second embodiment is shown.

(EXAMPLE 2)

On a 25-μm thick polyethylene terephthalate film as a substrate sheet, a 2-μm thick first release layer was formed with ink composed of acrylic resins by a gravure printing method. Furthermore, a 0.8-μm thick anchor layer was formed thereon with curable polyurethane resin of two-part liquid system by a gravure printing method. Then, it was heated for 30 seconds at 160° C.

Moreover, aluminum was evaporated thereon by a metallizing method based on a known electronic heating method to form a 50-nm thick metal thin film layer.

A 4-μm thick, pattern-like adhesive layer was formed by a screen printing method with ink composed of the composition 1 described above.

A 2-μm thick second release layer was formed at a part which was not overlapped with the adhesive layer by a 10 parts of silicone resin with respect to solid content of nitrate.

Finally, a 2-μm thick character or letter as a color adhesive layer was printed with black ink, composed of thermosetting resin, on the second release layer, resulting in obtaining a transfer member with a metallic luster pattern.

The transfer member was adhered to a glass bottle processed by silane-coupling agent and then the substrate sheet was released therefrom. Thus, the metallic luster pattern and the printed pattern were presented on the bottle. Next, the patterns were heated for 30 minutes at 180° C. to cure the adhesive layer and simultaneously the fixing strength with respect to the bottle was improved The obtained product had very high surface strength and the metallic luster pattern gave a sensation of a very high three dimensional reality.

Figure 5:
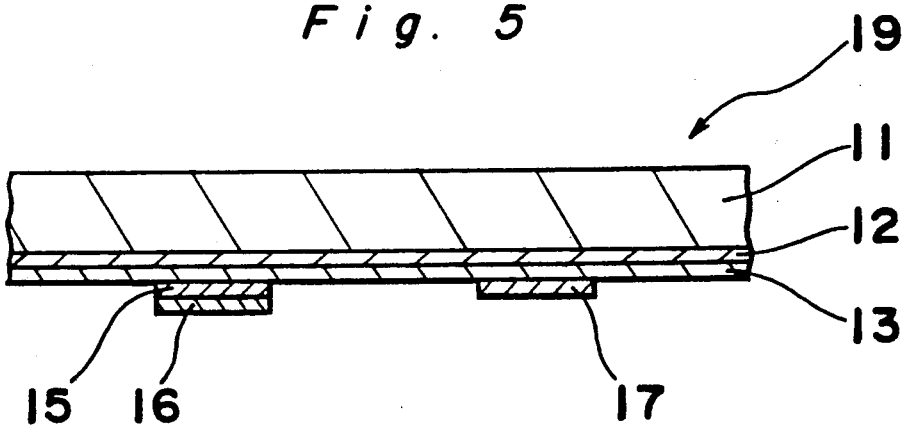
FIG. 5 is a cross-sectional view showing a transfer member with a metallic luster pattern according to a third embodiment of the present invention.
Figure 6:
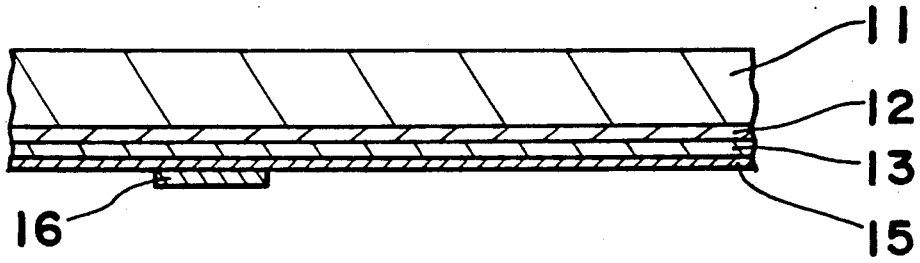
FIGS. 6 and 7 are respectively cross-sectional views showing manufacturing processes of the transfer member in FIG. 5.
Figure 7:
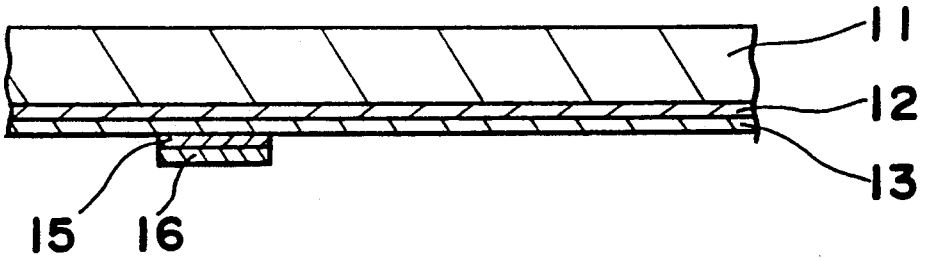
Figure 8:
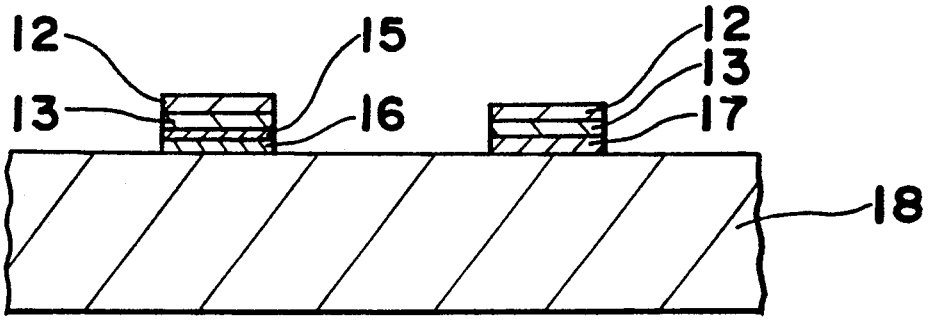
FIG. 8 is a cross-sectional view showing a state where the transfer member in FIG. 5 has been transferred to a substrate to be transferred.

Next, FIG. 5 is a cross-sectional view of a transfer member 19 with a metallic luster pattern according to a third embodiment of the present invention. FIGS. 6 and 7 are respectively cross-sectional views showing manufacturing processes of the transfer member 19 in FIG. 5. FIG. 8 is a cross-sectional view showing a state where the transfer member 19 has been transferred to a substrate 18 to be transferred. Reference numeral 11 denotes a release sheet, that is, a substrate sheet having release characteristics, 12 denotes a release layer, 13 denotes an anchor layer, 15 denotes a metal thin film layer, 16 denotes an adhesive layer, and 17 denotes a color adhesive layer.

The layer construction of the transfer member 19 according to the third embodiment is that the release layer 12 is formed on the whole surface of the substrate sheet 11, the pattern-like metal thin film layer 15 is partially formed on the release layer 12, the pattern-like adhesive layer 16 is formed on the metal thin film layer 15, and the color adhesive layer 17 is partially formed on at least the release layer 12 in a part which is not overlapped with the adhesive layer 16.

In order to obtain the transfer member 19 with such a layer construction, the member can be manufactured by the following method.

The same sheet as the substrate sheet 1 of the transfer member 10 according to the first embodiment is used as the substrate sheet 11.

Firstly, the release layer 12 is formed on the whole surface of the substrate sheet 11. The release layer 12 is released from the substrate sheet 11 after the transfer process and then serves as the surface of the metal thin film layer 15. The material, the forming method, and the thickness of the release layer 12 are similar to those of the release layer 2 of the transfer member 10 according the first embodiment.

Next, the metal thin film layer 15 is formed on the whole surface of the release layer 12. In FIG. 6, the layer 15 is formed on the whole surface of the anchor layer 13. The adhesive layer 16 allows the metal thin film layer 15 to form a metallic luster pattern to present the pattern. The material, the thickness, and the forming method of the metal thin film layer 15 are the same as those of the metal thin film layer 5 of the transfer member 10 according to the first embodiment.

Sequentially, the pattern-like adhesive layer 16 is formed on the metal thin film layer 15 (referring to FIG. 6). The adhesive layer 16 allows the release layer 12 and the metal thin film layer 15 to form a pattern after the transfer process, so that a metallic luster pattern is formed on the substrate 18 to be transferred. The forming method, the material, and the thickness of the adhesive layer 16 are similar to those of the adhesive layer 6 of the transfer member 10 according to the first embodiment.

Sequentially, a part, uncovered by the adhesive layer 16, of the metal thin film layer 15 is dissolved and removed therefrom by alkaline or acidic aqueous solution (referring to FIG. 7). For example, it can be dipped in solution of 5% caustic soda heated at 45° C. to be dissolved.

Next, the color adhesive layer 17 is formed at a specified part of the release layer 12 thereon to complete the transfer member 19 with a metallic luster pattern (referring to FIG. 5). That is, the color adhesive layer 17 can be formed not to overlap with the adhesive layer 16 or to overlap therewith. The same resin as that of the adhesive layer 16 can be used for the material of the color adhesive layer 17. The color adhesive layer 17 is a layer to form a printed pattern on the surface of the substrate 18 to be transferred and therefore, in order to present a desired color, pigment or dye for giving the desired color is mixed in solvent to an ink state, so that the mixture is used for the color adhesive layer 17.

As required, as shown in FIG. 6, the anchor layer 13 can be formed before forming the metal thin film layer 15. The anchor layer 13 is a layer to improve the adhesion properties between the release layer 12 and the metal thin film layer 15. The material of the anchor layer 13 for adhering the metal thin film layer 15 to the release layer 12 is not especially limited. The material and thickness of the anchor layer 13 are, for example, similar to those of the anchor layer 4 of the transfer member 10 according to the first embodiment.

As required, the coloring layer can be formed at the partial or whole surface between the release layer 12 and the metal thin film layer 15. The method for forming the coloring layer is similar to that of the coloring layer of the transfer member 10 according to the first embodiment.

Figure 9:
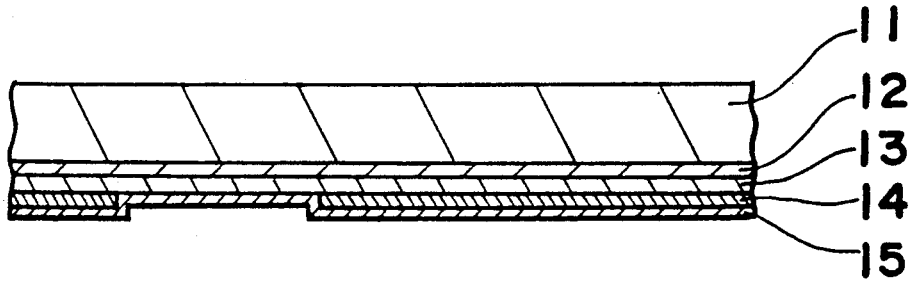
FIGS. 9 and 10 are respectively cross-sectional views showing manufacturing processes of a transfer member according to a modification of the third embodiment of the present invention.
Figure 10:
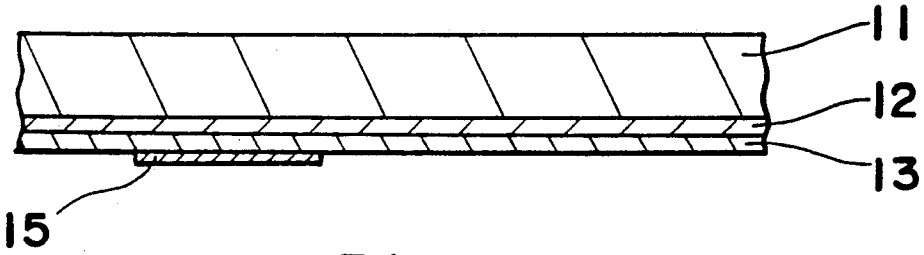
Figure 11:
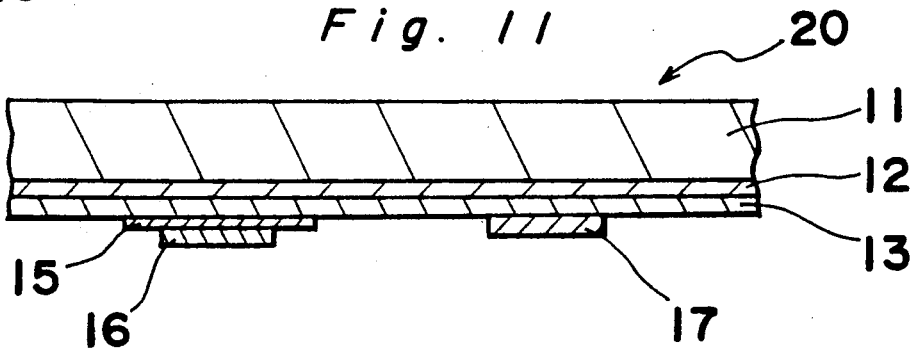
FIG. 11 is a cross-sectional view of the transfer member according to the modification in FIGS. 9 and 10.
Figure 12:
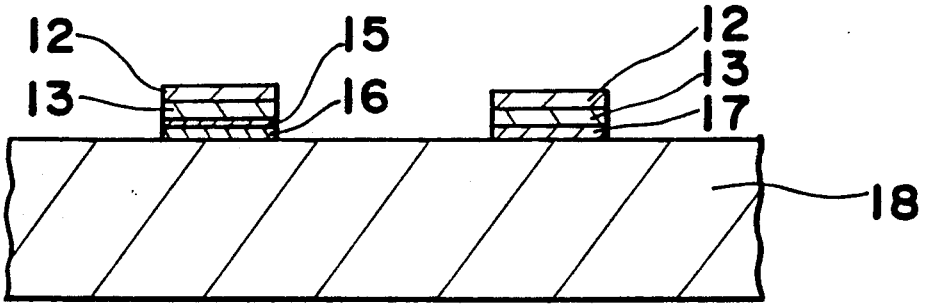
FIG. 12 is a cross-sectional view showing a state where the transfer member in FIG. 11 has been transferred to a substrate to be transferred.

The transfer member 20 according to a modification of the third embodiment can be manufactured by the following method. FIG. 11 is a cross-sectional view showing the transfer member 20 according to the modification of the transfer member 19 with a metallic luster pattern according to the third embodiment of the present invention. FIGS. 9 and 10 are respectively cross-sectional views showing the manufacturing processes of the transfer member 20 in FIG. 11. FIG. 12 is a cross-sectional view showing a state where the transfer member 20 according to the modification of the third embodiment has been transferred to the substrate 18 to be transferred.

Firstly, the release layer 12 is formed on the whole surface of the substrate sheet 11.

Next, as shown in FIG. 9, a pattern-like water-soluble resin 14 is formed on the release layer 12 through the anchor layer 13. The water-soluble resin 14 is a layer to be dissolved and removed in a washing process described later. The kind of resin employed for the water-soluble resin 14 is a resin such as polyvinyl alcohol or hydroxypropyl cellulose, which is mixed with solvent and pigment or dye to an ink state. Any method such as the gravure printing method or the screen printing method can be used for the printing method of the water-soluble resin 14.

Sequentially, the metal thin film layer 15 is formed on the whole surface of the release layer 12 on which the pattern-like water-soluble resin layer 14 is formed (referring to FIG. 9).

Next, the substrate sheet 11 on which the release layer 12, the water-soluble resin layer 14, and the metal thin film layer 15 are formed in order is washed by water. Various means such as dipping in water or warm water, shower cleaning by water or warm water, or ultrasonic cleaning in water or warm water can be used for the washing method The water-soluble resin layer 14 is dissolved in the water and then removed with the metal thin film layer 15 formed on the water-soluble resin layer 14 from the substrate sheet 11. In a case where the water soluble resin layer 14 is dissolved and removed therefrom insufficiently, the layer 14 can be mechanically removed, for example, wiped off with cloth or scraped off with a fine brush, after washing. In this way, the metal thin film layer 15 on the release layer 12 is formed in a pattern (referring to FIG. 10).

Sequentially, the pattern-like adhesive layer 16 is formed on the metal thin film layer 15. Then, the color adhesive layer 17 is formed on the release layer 12 (referring to FIG. 11).

As required, the anchor layer 13 can be formed before forming the water-soluble resin layer 14.

By the above-described method, the transfer member 20 capable of simultaneously forming a beautiful metallic luster pattern and a printed pattern having no metallic luster can be obtained.

After the transfer members 19 and 20 having the above-described layer constructions are overlapped on the substrate 18 to be transferred, they are heated and pressed.

Then, when the substrate sheet 11 is released therefrom, as shown in FIGS. 8 and 12, the sheet 11 is released at the interface between the sheet 11 and the release layer 12 in the part the adhesive layer 16 or the color adhesive layer 17 is formed thereon, and then the release layer 12 and the metal thin film layer 15 on which the adhesive layer 16 is formed and the adhesive layer 16, or the release layer 12 on which the color adhesive layer 17 is formed and the color adhesive layer 17 are adhered to the surface of the substrate 18 to be transferred.

In the part where the adhesive layer 16 and the color adhesive layer 17 are not formed thereon, the release layer 12 and the metal thin film layer 15 or the release layer 12 is not adhered to the substrate 18 and thus is released with the substrate sheet 11 therefrom.

In this way, a metallic luster pattern and a printed pattern having no metallic luster are simultaneously formed on the surface of the substrate 18 to be transferred.

In the transfer members 19 and 20 with metallic luster patterns according to the third embodiment, the release layer 12 is formed on the whole surface of the substrate sheet 11, the metal thin film layer 15 is partially formed on the release layer 12, the pattern-like adhesive layer 16 is formed on the metal thin film layer 15, and the color adhesive layer 17 is partially formed on the release layer 12. Therefore, the shrinkage of thermosetting resin in the heating process after the transfer process does not influence the metallic luster pattern formed by the transfer members 19 and 20 and thus a beautiful metallic luster pattern and printed pattern having no metallic luster can be simultaneously formed.

The method for manufacturing the transfer member 19 is so constructed that the release layer 12 is formed on the whole surface of the substrate sheet 11, the metal thin film layer 15 is formed on the whole surface thereof, the pattern-like adhesive layer 16 is formed thereon, thereafter the part of the metal thin film layer 15 which is not formed on the adhesive layer 16 is dissolved and removed therefrom by alkaline or acidic aqueous solution, and then the pattern-like color adhesive layer 17 is formed thereon. Therefore, the transfer member 19 capable of simultaneously forming a beautiful metallic luster pattern and printed pattern having no metallic luster can be easily manufactured.

Another method for manufacturing the transfer member 20 is so constructed that the release layer 12 is formed on the whole surface of the substrate sheet 11, the pattern-like water-soluble resin layer is formed thereon, the metal thin film layer 15 is formed on the whole surface thereof, thereafter the metal thin film layer formed on the water-soluble resin layer 14 is dissolved and removed therefrom with the water-soluble resin 14 by water washing, the adhesive layer 16 is formed at the part overlapped with the metal thin film layer 15, and then the pattern-like color adhesive layer 17 is formed thereon. Therefore, the transfer member 20 capable of simultaneously forming a beautiful metallic luster pattern and printed pattern having no metallic luster can be easily manufactured.

Hereinbelow, one concrete example of the third embodiment is shown.

(EXAMPLE 3)

On a 25-μm thick polyethylene terephthalate film, a 2-μm thick release layer was formed using ink of the composition 2 described below by the gravure printing method.

| Composition 2 | (parts by weight) |
|---|---|
| Prepolymer with acryloyl group bonded to the side chain of polymethyl methacrylate of 20,000 molecular weight | 100 |
| Organic solvent | 30 |
| Trimethylolpropane-triacrylate | 20 |
| Benzoin ethyl ether | 5 |

A 0.8-μm thick anchor layer was formed using curable polyurethane resin of two-part liquid system by the gravure printing method Then, it was heated for 30 seconds at 160° C.

Moreover, aluminum was evaporated thereon by a metallizing method based on a known electronic heating method to form a 50-nm thick metal thin film layer. Then, electron rays were irradiated to cure the release layer. The irradiating condition was 175kV, 90mA, 5Mrad in nitrogen atmosphere.

A 4-μm thick adhesive layer was formed in a pattern with ink of the above-described composition 1 by the screen printing method.

Next, by using 5% aqueous sodium hydroxide, a part of the metal thin film layer where the adhesive layer was not formed was dissolved and removed therefrom, and then washed with water.

Finally, a 2-μm thick character or letter as a color adhesive layer was printed with black ink of the composition 1 by the screen printing method, resulting in obtaining a transfer member with a metallic luster pattern.

The transfer member was adhered to a glass bottle and then the substrate sheet was removed therefrom.

Next, the pattern was heated for 30 minutes at 180° C. to cure the adhesive layer and simultaneously the fixing strength with respect to the bottle was improved. A beautifully decorated bottle on which only the metallic luster pattern and the printed pattern were formed was obtained.

(EXAMPLE 4)

On a 25-μm thick polyethylene terephthalate film, a 2-μm thick release layer was formed using ink of the composition 2 by the gravure printing method A 0.8-μm thick anchor layer was formed using curable polyurethane resin of two-part liquid system by the gravure printing method.

Moreover, by using hydroxypropyl cellulose, a 2-μm thick water-soluble resin layer was formed in a pattern on the anchor layer by the screen printing method. Thereafter, it was heated for 30 seconds at 160° C.

Furthermore, aluminum was evaporated thereon by a metallizing method based on a known electronic heating method to form a 50-nm thick metal thin film layer.

Sequentially, the water-soluble resin and the metal thin film layer formed thereon were dissolved and removed therefrom by water washing to allow the metal thin film layer to form in a pattern.

Next, a 4-μm thick adhesive layer was formed in a pattern with ink of the composition 3 described below by the screen printing method.

| Composition 3 | (parts by weight) |
|---|---|
| Thermosetting acrylic resin (HR-672 made by Mitsubishi Rayon Co., Ltd.) | 90 |
| Melamine resin (Uban 20SE-60 made by Mitsui Toatsu Chemicals, Inc.) | 20 |
| Silica | 20 |
| Isophorone | 20 |

A 2-μm thick character or letter as a color adhesive layer was printed with ink of the composition 3 which was changed in black, resulting in obtaining a transfer member with a metallic luster member.

The transfer member was adhered to a glass bottle processed by silane-coupling agent and then the substrate sheet was released therefrom.

Next, the pattern was heated for 30 minutes at 180° C. to cure the adhesive layer and simultaneously the fixing strength with respect to the bottle was improved Thus, a beautifully decorated bottle on which only the metallic luster pattern and the printed pattern were formed was obtained.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method for manufacturing a transfer member with a metallic luster pattern, which comprises forming a release layer on a whole surface of a release sheet, forming a metal thin film layer directly or indirectly on a whole surface of the release layer, forming a pattern of an adhesive layer comprised of thermosetting resin and 5-70 parts by weight of pigment on the metal thin film layer, dissolving and removing a part of the metal thin film layer on which the adhesive layer is not formed by alkaline or acidic aqueous solution, and forming a pattern of a color adhesive layer on the release layer.

* * * * *